United States Patent [19]

Sadler

[11] 4,101,295

[45] Jul. 18, 1978

[54] APPARATUS FOR CONVERTING COAL INTO GAS SUBSTITUTES

[76] Inventor: John H. Sadler, 16 Lakeside La., Bolton, Conn. 06040

[21] Appl. No.: 714,765

[22] Filed: Aug. 16, 1976

[51] Int. Cl.[2] ..... C10J 3/58

[52] U.S. Cl. ..... 48/99; 48/120; 48/DIG. 7

[58] Field of Search ..... 48/99, 90, 108, 118.5, 48/120, 20 L, DIG. 4, DIG. 7, 105, 210; 202/113

[56] References Cited

U.S. PATENT DOCUMENTS

| | | | |
|---|---|---|---|
| 447,506 | 3/1891 | DeMill | 48/99 |
| 1,530,281 | 3/1925 | Murrie | 48/202 |
| 1,941,809 | 1/1934 | McKee | 48/DIG. 4 |
| 2,572,061 | 10/1951 | Seller | 48/DIG. 7 |
| 2,595,234 | 5/1952 | Eastman | 48/DIG. 7 |
| 2,657,124 | 10/1953 | Gaucher | 48/202 |
| 3,124,435 | 3/1964 | Byrne et al. | 48/105 |
| 3,779,725 | 12/1973 | Hegarty et al. | 48/202 |
| 3,888,043 | 6/1975 | Child et al. | 48/210 |
| 3,933,618 | 1/1976 | Patton | 48/210 |

*Primary Examiner*—S. Leon Bashore
*Assistant Examiner*—Peter F. Kratz
*Attorney, Agent, or Firm*—Arthur T. Fattibene

[57] ABSTRACT

Apparatus for converting coal into a gas substitute in which a slurry mix of pulverized coal and water is heated to form an emulsion which is then successively passed through a catalytic chamber and a convertor chamber.

The catalyzed emulsion mix is heated to destructive distillation temperatures in the convertor chamber as superheated steam is introduced into the convertor chamber to effect a continuous destructive distillation process. The products of destructive distillation are then successively scrubbed, condensed and passed through separators to separate the solids and free hydrogen from the gaseous constituents with a portion of the distillation products not comprising the final natural gas substitutes being recycled to the burner as fuel to generate the heating temperatures necessary to perform the method. The condensed water is also recycled to form the slurry or the steam introduced into the convertor.

11 Claims, 3 Drawing Figures

FIG. 3
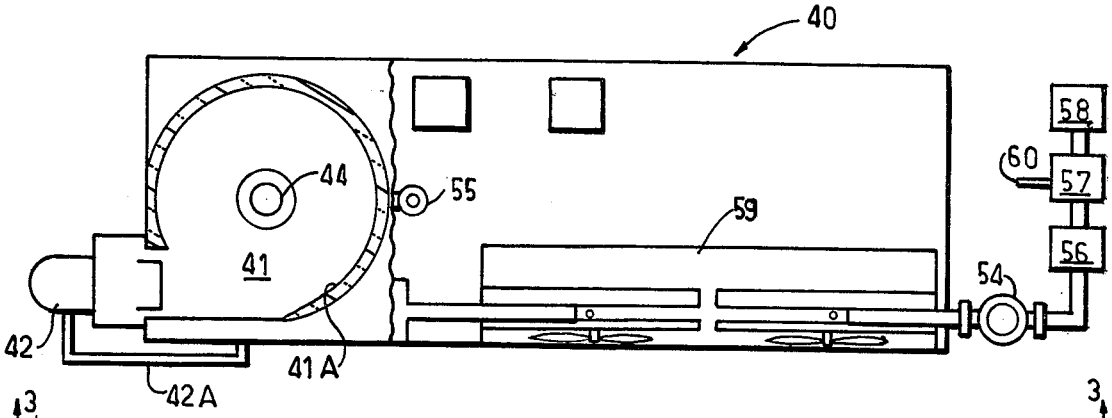
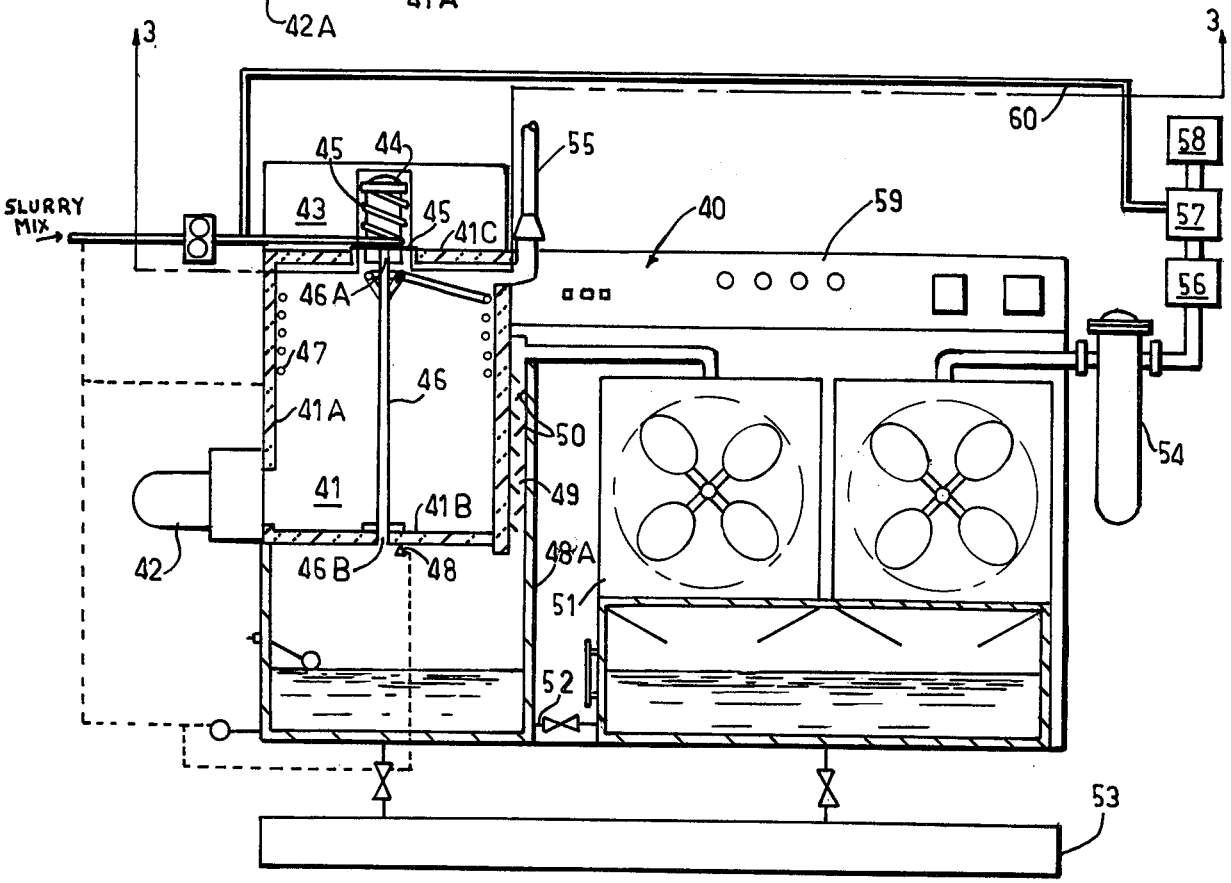
FIG. 2

APPARATUS FOR CONVERTING COAL INTO GAS SUBSTITUTES

BACKGROUND OF THE INVENTION

With the energy crisis ever increasing and forcing the curtailment and/or depletion or natural gas reserves, various processes and apparatuses have evolved using manufactured gas technology to produce methane or substitute gases to supplement or substitute for natural gas. One such method and apparatus is disclosed in my U.S. Pat. No. 3,124,435 in which the feed stock for producting natural gas substitutes was oil. However, with the increasing cost of oil, the economics of producting natural gas substitutes from oil may be prohibited. It is therefore desirable to effect the production of natural gas substitutes from a more economical feed stock, e.g., coal.

Many efforts have been made to produce natural gas substitutes from coal. However, such efforts for the most part resulted in fairly complex and costly systems. Also the known coal gasification systems intermittent in operation due to coking or other phenomena which interferes or renders impossible continuous operation of the system.

OBJECTS

It is therefore an object of this invention to provide a method and apparatus for effecting the destructive distillation of coal into natural gas substitutes utilizing a simple and compact apparatus which is adapted to operate in a continuous manner.

Another object is to provide a method and apparatus whereby a portion of the heavier products of distillation are recirculated for use as fuel for generating the heat required to effect the distillation of coal.

Another object resides in a method and apparatus for producing coal gas without coking.

Another object is to provide a method and apparatus for producing natural gas substitutes from coal in a closed and continuously operating system.

BRIEF SUMMARY OF THE INVENTION

The foregoing objects and other features and advantages are attained by a method and apparatus in which slurry mix of pulverized coal and water is formed. The slurry mis so formed is then heated to a temperature ranging between 500° to 850° F and passed over a suitable catalyst in a catalytic reactor chamber to effect the emulsification thereof.

From the catalytic reactor chamber, the heated slurry mix is directed to a convertor chamber and further heated to a temperature of 950° to 1500° F. Superheated steam is injected ninto the converter chamber to mix with the products of coal distillation in the converter; and to convey the products of distillation through the converter within a residence time of approximately 3 to 5 seconds.

Upon exiting the converter chamber, the products of the coal distillation are then passed through a scrubber where the non-gasified constituents are separated out and recirculated to the burner as fuel for generating the heat required for the system or method.

The separated gaseous affluents are conveyed through a condensor wherein the gases are cooled with any entrained water vapor being condensed out.

From the condensor the cooled gases are dircted through a first separator in which any entrained solid particles, e.g., sulphur or ash, are separated from the gases. The particle free gases are then directed to a gas separator in which the free hydrogen $H_2$ is separated out and recirculated to the slurry mix to increase the B.T.U. content thereof. The remaining gases free of free hydrogen are then collected in a suitable holder and rendered available for use as a natural gas substitute.

In accordance with this invention, the gas convertor comprises a elongated chamber or tube which has an inlet into which the catalyzed emulsified slurry is introduced, and an outlet. The tube or chamber diverges from the inlet to outlet thereof. Superheated steam is introduced tangentially of the inlet end to feed and advance the products of distillation through the convertor tube. The arrangement is such that "coking" of the gases and/or any build up of coke particles within the convertor tube is prohibited. Upon passing through the convertor, the products of distillation are condensed and the water condensate recycled as feed water for reuse in the process.

FEATURES

A feature of this invention resides in the provision of a method and apparatus wherein coal in a pulverized slurry mix constitutes the feed stock for producing natural gas substitutes in a continuous operation.

Another feature of this invention resides in the provision of a compact apparatus wherein a pulverized coal slurry preheated in the presence of a catalytic agent and thereafter heated to destructive distillation temperatures in the presence of superheated steam.

Another feature resides in the provision of a method and apparatus for effecting the continuous destructive distillation of coal wherein a portion of the non-gaseious affluents are recirculated as fuel to the burner for generating the heat requirement necessary for effecting the distillation of the coal.

Another feature of the invention resides in a method and apparatus wherein the free $H_2$ is separated from the gases formed and recirculated for mixture with the pulverized coal slurry feed stock to increase the B.T.U. content thereof.

Another feature of this invention resides in the provision of a relatively simple compact apparatus for converting coal into a natural gas substitute wherein the coal feedstock is pulverized, preheated to form an emulsion, passed over a catalytic agent, converted to gas, which is then scrubbed, condensed, and separated in a continuous manner in a closed system.

Another feature resides in a coal gasification apparatus having an improved converter chamber having diverging walls from the inlet to outlet thereof.

Other features and advantages will become more readily apparent when considered in view of the specification and drawings in which:

FIG. 2 is a modified embodiment illustrated in a front elevational view with parts shown in section.

FIG. 3 is a top plan view of FIG. 2 taken along line 3—3 on FIG. 2.

DETAILED DESCRIPTION

Figure 1:
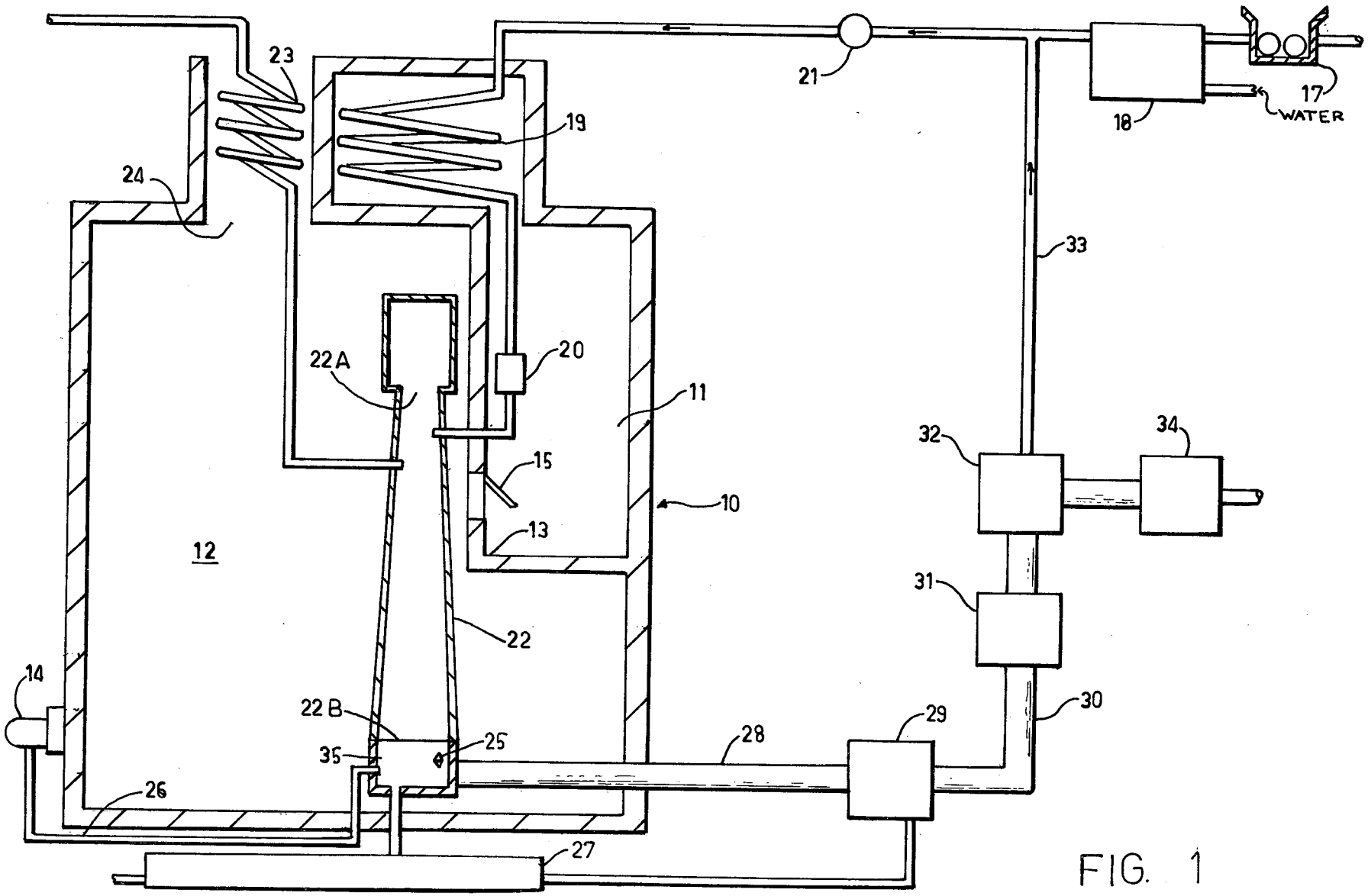
FIG. 1 is a diagramatic showing of an apparatus embodying the present invention.

This invention is directed to a method and apparatus for converting coal into a natural gas substitute by a continuous process of destructive distillation of coal. This is attained by effecting the pulverization of coal by means of a pulverizing mill and thereafter mixing the pulverized coal with water to form a slurry mix which can be readily conducted by pumping through a catalytic chamber.

The slurry mix of pulverized coal and water is preheated as it flows to the catalytic chamber. In the catalytic chamber, the preheated slurry mix is brought into contact with a suitable catalyst which may comprise coke, nickel, platinum and the like. As the slurry mix is passing through the catalytic stage, it is heated to a temperature ranging between 500° F to 850° F. to effect the emulsification and aid in breaking down the slurry.

The catalyzed coal slurry emulsion upon exiting the catalytic chamber is then directed to a convertor chamber wherein it is further heated to a temperature ranging between 950° to 1500° F to effect the destructive distillation of the coal. Superheated steam is introduced into the convertor chamber to mix with the products of distillation being formed therein, and to convey the products of distillation through the convertor chamber in a fairly rapid manner so that the resident time of the coal slurry in the convertor constitutes a relative short time interval, e.g., 3 to 5 seconds. The convertor chamber is formed with an inlet and outlet whereby the chamber progressively diverges from the inlet end thereof to the outlet end thereof.

Upon exiting the outlet end of the convertor chamber, the products of distillation thus formed are passed through a scrubber wherein the heavier constituents of the distillation, e.g., the non-gaseous constituents are separated out. Accordingly, the burnable, non-gasified constituents which are separated at the scrubber are recirculated to the burner, and used as a fuel supplement therefor for generating the heat requirements for the described process.

The steam for introduction into the convertor chamber is generated by passing water through a steam coil disposed about the convertor chamber and the superheated steam thus generated is introduced tangentially into the convertor chamber adjacent the inlet thereto.

From the scrubber, the gaseous products of distillation are passed through a condensor where the gases and any enstrained water vapor are cooled and condensed, the water condensate being suitably collected at both the scrubber phase and condensor phase wherein the water condensate is recirculated and used as make-up water for the coal slurry mix and/or for generation into superheated steam for introduction into the convertor chamber.

The condensed or cooled gases are then passed to a mist filter. From the mist filter the gases are passed through a first separator in which any enstrained sulphur, ash or solids can be separated from the condensed gases. Thereafter the gases are passed through a second gas separator wherein the free hydrogen is separated from the gaseous products of distillation. According to this invention, the separated free hydrogen is recirculated and mixed with the slurry mix prior to heating thereof to increase the B.T.U. content thereof. From the gas separator, the gaseous products of combustion are directed to a holder or suitable storage tank for use by an ultimate consumer.

FIG. 1 illustrates a diagramtic showing of an apparatus whereby the foregoing method can be continuously performed. Referring to FIG. 1, the apparatus comprises a furnace or housing 10 to define a first and second heating chamber 12 and 11. In the illustrated embodiment, a wall or partition 13 separates the first heating chamber 12 from the second heating chamber 11. A suitable burner 14 is disposed in the wall of the furnace for generating the heating requirements of the system. It will be understood that any suitable burner may be employed.

In the illustrated embodiment, the partition 13 is provided with a temperature controlled damper or other means 15 to control the temperatures of the respective heating chambers 11 and 12, whereby the temperature in the first heating chamber 12 can be maintained within a range of 950° F to 1500° F, and the temperature in the second chamber 11 maintained in a range between 500° F to 850° F.

Disposed in heating chamber 11 is a heating coil 19 and a catalytic chamber 20. The catalytic chamber 20 is a vessel in which a suitable catalyst is contained to facilitate the breakdown of the coal as will be hereinafter described. Any suitable catalyst may be employed; e.g., coke, nickel, platinum and the like.

As shown in FIG. 1, coal is pulverized in a pulverizing mill 17, the pulverized coal thereafter being mixed with water in a suitable mixer 18 to form a coal slurry. From the mixer 18, the coal slurry is conveyed by suitable pump means 21 through the heating coil 19 whereby the slurry mix is preheated. The preheated slurry mix is then conveyed to the catalytic chamber to come into contact with the catalyst and is further heated to a temperature of 500° to 850° F.

As the catalized slurry mix exits the catalytic chamber 20, it is conveyed to a convertor 22 wherein the slurry mix is broken down into its constituent components. In the illustrated embodiment, the convertor 22 comprises an elongated chamber which has an inlet 22A and an outlet 22B wherein the chamber 22 progressively diverges from inlet 22A to outlet 22B. By diverging the chamber 22, coking up of chamber is minimized. Also the configuration of the convertor chamber in conjunction with the tangential introduction of steam, as will be hereinafter described, imparts a kinetic energy to develop a cyclone effect to optimize the flow and destructive distillation of the slurry mix as it passes through the convertor chamber 22.

A steam heating steam coil 23 is disposed in heating chamber 12 adjacent the stack outlet 24, whereby superheated steam is generated. The superheated steam thus generated is tangentially introduced into the inlet 22A of the convertor to mix with and assist the destructive distillation of the coal slurry introduced in the convertor. Also, a cyclonic effect is imparted to the slurry mix in the convertor chamber to quickly convey the slurry mix through the chamber so that the destructive distillation thereof can be effected within 3 to 5 seconds of residence time within the chamber 22. As hereinbefore stated, the temperature within chamber 12 is such that destructive distillation of the coal slurry is effected as it is conveyed through the convertor chamber 22.

Adjacent the outlet end 22B of the convertor chamber 22, there is disposed a scrubber 35 in which the heavier or non-gaseous constituents of the products of the destructive distillation are separated out. The scrubbing action is mechanically effected by passing the products of distillation over baffles and by contact with a water spray 25. The burnable, heavier and non-gaseous constituents are collected and recirculated through conduit 26 to the burner 14 to be used as a fuel supplement for the burner 14. The residual water in the scrubber 35 is collected in a suitable collecting tank 27 and is reused as make-up water for the steam generating phase and/or slurry mixing phase of the described system.

The scrubbed products of distillation are then conveyed through conduit 28 to a condensor 29 where the products of distillation are cooled and any entrained water vapor being condensed, the water condensate being collected in the water collecting tank 27.

The cooled products of distillation are then conveyed by conduit 30 to a first separator 31 in which any entrained solid particles such as ash, sulphur, the like are separated from the cooled gaseous products of distillation.

The particle free cooled gases are then conveyed to a gas separator 32, wherein the free hydrogen is separated from the cooled gases of distillation. The separated free hydrogen in conveyed by means of conduit 33 to mix with the coal slurry mix to increase the B.T.U. content thereof.

The finally separated products of distillation are then delivered to a holding or storage tank 34 from whence it is supplied to an ultimate consumer.

FIGS. 2 and 3 illustrate a commercial application of a package unit. As shown, the embodiment of FIGS. 2 and 3 includes a generally rectangular unit or housing 40 which can be sized so as to render it readily portable, ie., it can be placed on a rolling platform or truck; or can be fabricated as a stationary station. The illustrated embodiment includes a generally circular furnace chamber 41 which is tangentially fired by a suitable burner 42. Thus the furnace is defined by a circular end wall 41A, a bottom wall 41B and a top wall 41C to define the main heating chamber. Disposed above the top wall 41C is a heating chamber 43 for the catalytic chamber 44. The heating chamber 43 is connected to the main furnace chamber 41 by a temperature controlled damper 45 so that catalytic chamber can be subjected to temperatures of 500° to 850° F whereas the main chamber can be heated to destructive distillation temperatures of 950° to 1500° F. Disposed about the catalytic chamber 44 is a preheating coil 45 for preheating the coal slurry mix prior to introduction into the catalytic chamber or vessel 44.

The inlet end of the catalytic chamber 44 connects with a convertor tube 46 which progressively diverges from the inlet 46A to outlet 46B thereof. Steam, generated in a steam coil 47 circumscribing or lining the furnace wall 41A, is introduced tangentially into the inlet end 46A of the convertor and is used as the medium for assisting the distillation and passing of the products of distillation through the convertor tube 46. The products of combustion generated in the furnace chamber 41 are exhausted through a stack 55.

Below the furnace chamber 41 is a scrubber for effecting the separating of the heavier constituents of the distillation from the gaseous products of the distillation. This is attained by scrubbing the products of distillation with a water spray 48 in a scrubber 48A. The excess water from the scrubbing action collects at the bottom and is collected for reuse.

The scrubber products of distillation pass upward through a channel 49 and over a series of baffles 50 therein to effect a mechanical scrubbing action. From channel 49 the products of distillation are passed through an air cooled condensor 51 where the products of distillation are cooled and condensed, with the water condensate collecting at the bottom of the condensor 51. If desired, the bottom of the condensor 51 may be connected to the bottom of the scrubber 48A by an interconnecting valved connection 52 so as to maintain a common water lever thereon. A water than 53 is connected to the bottom of the respective scrubber 48A and condensor 51. The water used in the system can thus be collected in tank 53 and reused by circulation to mix with the powder coal to form the slurry mix or to the steam coil 47 or to spray 48 indicated by the dotted lines.

The cooled products of distillation are then passed through a mist filter 54 to extract any entrained vapor.

As hereinbefore described the heavier constituents of the products of distillation separated at the scrubber 48A are directed to the burner 42 through a suitable conduit 42A and used as a fuel supplement therein.

After passing through the mist filter the cooled gaseous products of the distillation are directed to a first separator 56 where the solid particles, e.g., ash, sulphur, coke, if any, are separated. The particle free gases are then directed to a second or gas separator 57 wherein the free hydrogen is separated from the remaining coal gases. The finally separated gases are then conducted to a holding or storage tank 58.

The free hydrogen which is separated out in separator 57 is directed by way of conduit 60 so as to be mixed into the slurry mix as hereinbefore described.

In all other respects the operation and function of the embodiment shown in FIGS. 2 and 3 is similar to that hereinbefore described.

As shown, the embodiment of FIGS. 2 and 3 includes a control panel 59 so that the temperature and flow during the process can be monitored or regulated as required.

From the foregoing it will be apparent that a method and apparatus is provided whreby coal may be continuously converted to a coal gas for use as a substitute for natural gas; and that the conversion is effected in a simple and positive manner; with a minimum of waste and expenditure. By utilizing a coal slurry of pulverized coal and water, conversion of the coal can be effected by destructive distillation with a minimum of coking.

While the invention has been described with respect to the distillation of pulverized coal to form a substitute for natural gas, it will be understood that the coal gases formed may be used as a substitute for any type of fuel gas, i.e, either a natural gas of a manufactured gas made by other methods. Also, it will be understood that if it is desirable to manufacture a low B.T.U. gas substitute from pulverized coal, the step of separating and recirculating the free $H_2$ to the slurry mix can be eliminated from the described process. In other words, if a high B.T.U. content gas substitute is desired, the free hydrogen separated at the gas separator 32 or 57 is circulated and mixed with the coal slurry prior to distillation. If a low B.T.U. gas substitute is desired, the free hydrogen is not separated from the gaseous products of distillation. As used herein a low B.T.U. gas is defined as having at least 450 B.T.U. and a high B.T.U. gas as having 1010 to 1020 B.T.U.'s.

While the invention has been described with respect to particular embodiments thereof, it will be understood and appreciated that variations and modifications can be made without departing from the spirit or scope of the invention.

What is claimed is:

1. An apparatus for converting coal into a natural gas substitute comprising:

a furnace defining a first heating chamber and a second heating chamber, a means connecting said first heating chamber in communication with said second heating chamber, a burner disposed in said first heating chamber for generating heating products of combustion, said connecting means including a temperature controlled damper to regulate the flow of said heating products of combustion between said first and second heating chambers, a catalytic chamber containing a catalytic agent disposed in said second heating chamber in heat transfer relationship to the heating products of combustion therein, means for mixing pulverized coal with water to form a slurry mix, means for conducting said slurry mix in heat transfer relationship to the heating gases in said second chamber for preheating said slurry mix, and said conducting means being connected to said catalytic chamber whereby said preheated slurry mix is brought into contact with the catalytic agent in said catalytic chamber to form a catalyzed heat emulsion, a convertor chamber disposed in said first heating chamber, means connecting said catalytic chamber to said convertor chamber whereby the heated catalyzed emulsion flows from said catalytic chamber to said convertor chamber, a steam generator disposed in said first heating chamber in heat transfer relation to the heating combustion gases therein, said steam generator being connected to said convertor for introducing steam in said convertor to mix with the catalyzed emulsion introduced thereinto, said burner means heating said convertor chamber to coal distillation temperatures to produce the coal gas constituents, and means for removing the coal gas constituents from said convertor chamber.

2. The apparatus as defined in claim 1 wherein said convertor chamber has an inlet end and an outlet end, and said convertor chamber diverging from said inlet end to said outlet end.

3. The invention as defined in claim 2 wherein said convertor includes a steam inlet connected to said steam generator for introducing steam tangentially into said convertor chamber.

4. The apparatus as defined in claim 1 and including means for recirculating a portion of the products of distillation to the heating means for use as a fuel therefor.

5. The apparatus as defined in claim 2, said convertor chamber having an outlet end and including a scrubber means disposed adjacent the outlet end of said convertor chamber, said scrubber means being connected in communication with the outlet end of said convertor chamber.

6. The invention as defined in claim 5 and including a condensing means connected to and in communication with said scrubber for condensing the vapor and gaseous mixture exiting the outlet of said convertor chamber and passing through said scrubber means.

7. The apparatus as defined in claim 6 and including a first separator means connected to said condensing means for receiving the gaseous mixture from said condensing means for separating the solid particles from the gaseous products of the coal distillation.

8. The apparatus as defined in claim 7 and including a gas separator connected to said first separator means for separating the free $H_2$ from the gaseous products of distillation.

9. The apparatus as defined in claim 8 and including means connected to said slurry conducting means and said gas separator for conducting the separated free $H_2$ in said gas separator to be mixed in the slurry mix.

10. The apparatus as defined in claim 6 and including means interconnected between said condensor and steam generator for recirculating the vapor condensed in said condensing means to said steam generator.

11. The apparatus as defined in claim 10 wherein said steam generator comprises a steam coil disposed in said first heating chamber.

* * * * *